US006871375B2

(12) United States Patent
Borcherds

(10) Patent No.: US 6,871,375 B2
(45) Date of Patent: Mar. 29, 2005

(54) SECTIONAL BATH SPONGE AND METHOD OF MANUFACTURE

(75) Inventor: Suzanne Borcherds, Thermal, CA (US)

(73) Assignee: Bradford Soap Mexico, Inc., West Warnick, RI (US)

( * ) Notice: Subject to any disclaimer, the term of this patent is extended or adjusted under 35 U.S.C. 154(b) by 143 days.

(21) Appl. No.: 09/977,756

(22) Filed: Oct. 15, 2001

(65) Prior Publication Data

US 2003/0070245 A1 Apr. 17, 2003

(51) Int. Cl.[7] ..... A47K 7/02

(52) U.S. Cl. ..... 15/209.1; 15/229.11; 300/21; 401/201

(58) Field of Search ..... 15/209.1, 229.11, 15/229.12; 300/21; 401/201

(56) References Cited

U.S. PATENT DOCUMENTS 1,482,016 A * 1/1924 Kingman ..... 15/229.11
2,581,779 A 1/1952 Abraham
2,666,249 A 1/1954 Ruiz et al.
2,849,821 A 9/1958 Doig
3,146,479 A 9/1964 Stoker
3,281,884 A 11/1966 Feil
3,336,618 A 8/1967 Day
3,345,668 A 10/1967 Forrest
3,816,888 A 6/1974 Rather, Jr.
3,922,407 A 11/1975 Nimmo, Jr. et al.
4,034,443 A 7/1977 Turner
4,199,835 A 4/1980 Heyer et al.
4,454,968 A 6/1984 St.Lawrence
4,462,135 A 7/1984 Sanford
4,585,676 A 4/1986 DeSmet et al.
4,659,495 A 4/1987 Figliola
4,714,182 A 12/1987 Hecht
4,840,822 A 6/1989 Cheng
4,919,980 A 4/1990 Pirkey
5,144,744 A 9/1992 Campagnoli
5,356,056 A 10/1994 Teuten
5,411,188 A 5/1995 Teuten
5,650,384 A 7/1997 Gordon et al.
5,687,447 A 11/1997 Bynum et al.
5,709,434 A 1/1998 Chen
5,740,599 A 4/1998 Chang
5,758,386 A 6/1998 Chen
5,766,700 A 6/1998 Borcherds
5,784,747 A 7/1998 Girardot et al.
5,813,523 A 9/1998 Gnadt et al.
5,904,409 A 5/1999 Girardot et al.
5,937,472 A 8/1999 Girardot et al.
5,944,032 A 8/1999 Masterson
5,946,780 A 9/1999 Borcherds et al.
5,970,566 A 10/1999 Giradot et al.
6,038,727 A 3/2000 Chen
6,092,257 A 7/2000 Chen
6,105,196 A * 8/2000 Chang ..... 15/209.1
6,120,102 A 9/2000 Buono
6,131,234 A 10/2000 Chen

* cited by examiner

*Primary Examiner*—Mark Spisich
(74) *Attorney, Agent, or Firm*—Workman Nydegger

(57) ABSTRACT

A method of manufacturing a bath sponge includes rolling each of a plurality of discrete lengths of flexible mesh-netting tube into a discrete substantially doughnut shaped band, each band bounding a central opening. Each band is stretched on a support structure so that the central opening of each band is at least partially aligned. Each of the bands are secured together at a first location and at a second location. Finally, the bands are released from the support structure so that the bands rebound into a substantially spherical bath sponge bounding a central pocket.

18 Claims, 4 Drawing Sheets

SECTIONAL BATH SPONGE AND METHOD OF MANUFACTURE

CROSS-REFERENCE TO RELATED APPLICATIONS

Not applicable.

BACKGROUND OF THE INVENTION

1. The Field of the Invention

The present invention relates to bath sponges and methods for manufacturing bath sponges made from a flexible mesh material.

2. The Relevant Technology

Mesh bath sponges, also referred to as puffs, have become increasingly popular. Such sponges are generally used to facilitate soap application and skin exfoliation while bathing or showering. Conventional mesh sponges are typically made from a polymeric mesh netting material. The material is manipulated into a gathering of irregular ruffles that produce a generally spherical configuration. Mesh sponges have been well received in part due to the advantages they provide over conventional sponges or washcloths. For example, they increase and facilitate soap lathering and dry quickly to prevent bacterial growth. Although prior art mesh sponges are generally effective for their intended purposes, they have a number of shortcomings.

For example, due to the irregular ruffles, conventional sponges are often deformed, thereby hampering their market appeal. Likewise, the ruffles can produce a more abrasive feel than some desire. Furthermore, many prior art sponges have a relatively short life due to their fragile makeup and tendency to unravel. In addition, many conventional mesh sponges are secured together at their center, thereby forming a hard, dense core, which can hinder rinsing and drying.

The present invention seeks to overcome and/or ameliorate these disadvantages while providing an aesthetically and tactilely pleasing bath sponge.

BRIEF SUMMARY OF THE INVENTION

The present invention provides a novel bath sponge and method of manufacture. The method includes manipulating each of a plurality of discrete lengths of flexible mesh-netting tube into a discrete substantially doughnut shaped band, each band bounding a central opening. The manipulation can including folding and/or rolling the each tube into the desired configuration.

Each band is then stretched on a support structure so that the central opening of each band is at least partially aligned. The support structure can comprises a pair of spaced apart posts over which each of the bands are stretched. Each of the bands are then secured together at a first location and at a spaced apart second location. Finally, the bands are released from the support structure so that the bands rebound into a substantially spherical bath sponge bounding a central pocket. If desired, an object such as soap, a toy, or a stuffed animal can be placed within the central pocket. A portion of the object, such as the head of a stuffed animal, can project between the bands and out of the sponge.

The resulting sponge has a number of advantages and benefits, some of which will be hereinafter described. For example, the sponge of the present invention is tied at opposing ends resulting in a configuration that retains its shape longer and resists unraveling to a greater degree. In addition, the sponge of the present invention is formed into a generally spherical configuration that maintains its shape and has a substantially smooth exterior surface. This results in a unique look and feel. Moreover, by alternating the bands with different colors, styles, and material properties, a wide variety of different sponges can be created. The method of the present invention is simple, quick, and easy to perform, making it amenable to use in mass production.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 7:
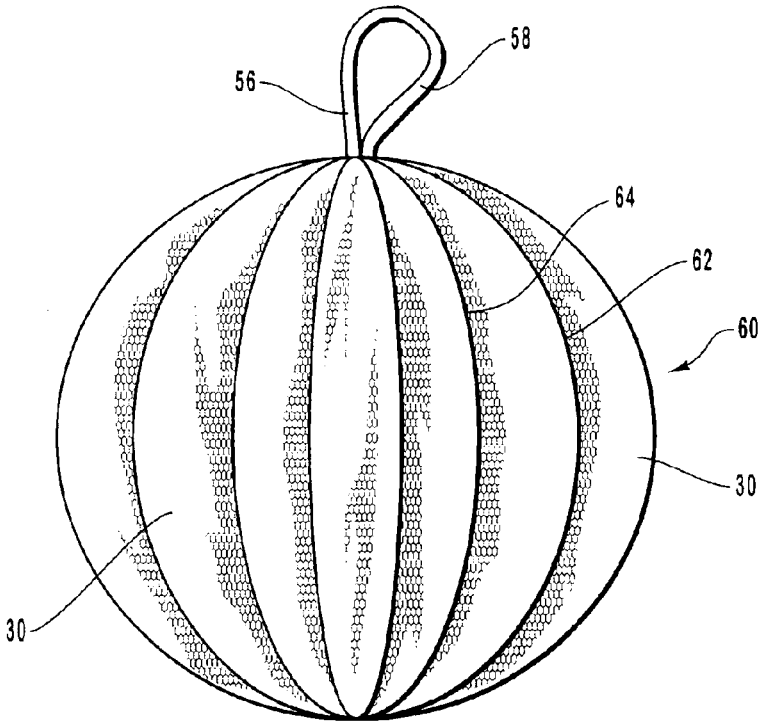
FIG. 7 is an elevated side view of a finished bath sponge of the present invention.

The present invention relates to bath sponges, also referred to as puffs, and methods for their manufacture. Depicted in FIG. 7 is one embodiment of a bath sponge 60 incorporating features of the present invention. The method of production is simple, quick, and easy, making it desirable for use in mass production. The novel bath sponge produced by the disclosed method has a unique look and feel and is highly durable relative to conventional bath sponges. The unique configuration also provides other advantages as disclosed or as are apparent herein.

Figure 1:
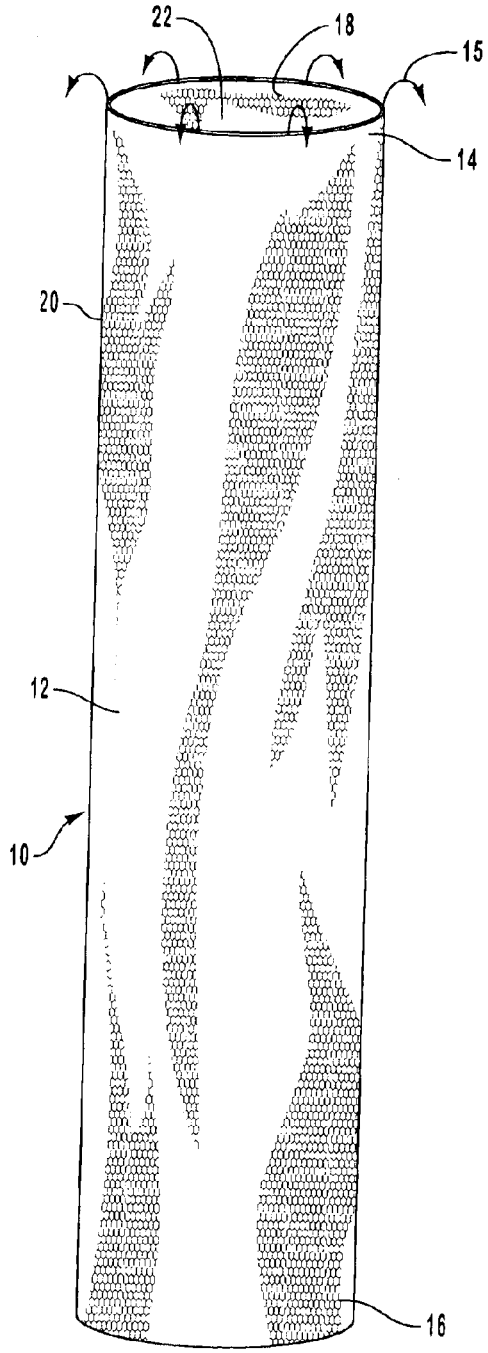
FIG. 1 is a perspective view of an elongated tube made of flexible mesh material used in practicing the method of the present invention.

Referring now to FIG. 1, an elongated tube 10, typically comprised of a flexible mesh netting material, is shown for use in production of bath sponge 60. Tube 10 has a boundary wall 12 with a substantially circular transverse cross-section. Boundary wall 12 has an interior surface 18 and an exterior surface 20 that each extend between an open first end 14 and an opposing open second end 16. Interior surface 18 bounds open space 22. Tube 10 typically has a length between about 1 foot to about 4 feet, with about 1 foot to about 2 feet being more preferred. Tube 10 also typically has a diameter between about 2 inches to about 4 inches, with about 2 inches to about 3 inches being more preferred. However, virtually any length and/or diameter of tubing can be used to practice the method of the present invention. The length and diameter of tube 10 will vary depending on the targeted user and the sought-after objectives.

In one embodiment tube 10 is made from a flexible polymer and, more preferably, from a polymeric mesh netting, such as a low density or high density polyethylene diamond mesh netting. The polyethylene diamond mesh netting is typically extruded in the form of an elongated tube. It is to be understood, however, that many variations of the tubing material and configuration are possible. For example, tube 10 can be extruded having a variety of alternative transverse cross section polygonal or irregular configurations. Furthermore, tube 10 can be formed from a variety of different polymeric materials having a variety of different colors and different physical properties such as texture. In yet other embodiments, it is appreciated that tube 10 can be comprised of other fabrics or materials that need not be polymeric or have a mesh configurations. Such materials can be sewn into the tubular configuration.

Figure 2:
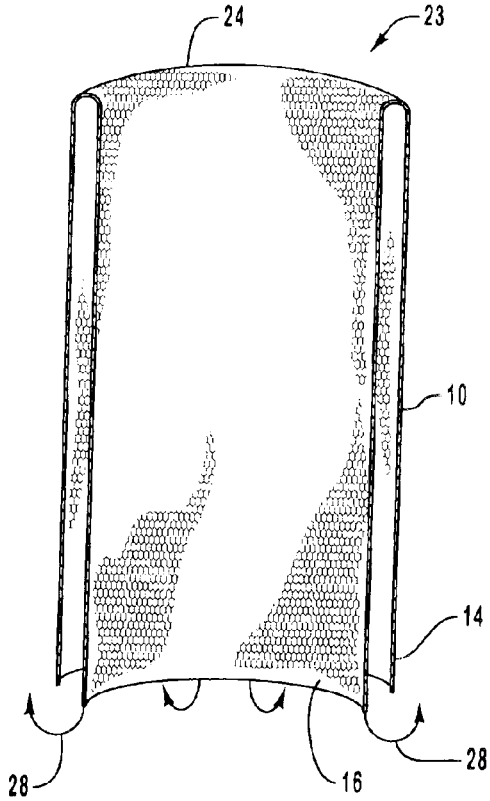
FIG. 2 is an elevated cross-sectional side view of the tube in FIG. 1 after having been folded down upon itself.

Depicted in FIGS. 1 and 2, during manufacture tube 10 is first manipulated to a first folded position 23. Specifically, starting with first end 14, tube 10 is first folded inside-out over itself, as shown by arrows 15 in FIG. 1, until ends 14 and 16 are substantially aligned, as shown in the cross-sectional view of FIG. 2. In first folded position 23, tube 10 extends between an annular first fold 24 and substantially aligned ends 14 and 16.

Figure 3:
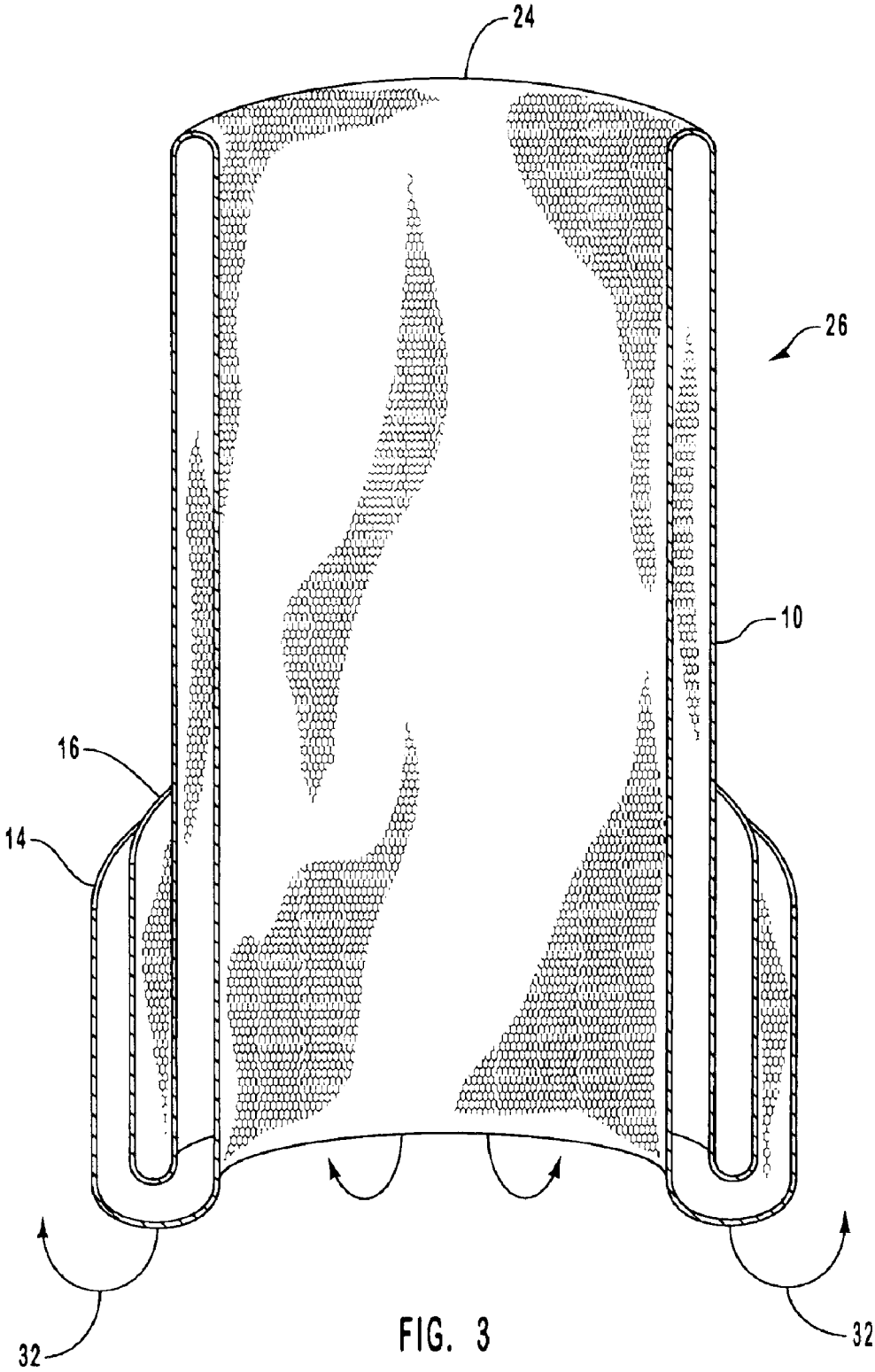
FIG. 3 is an elevated cross-sectional side view of the tube in FIG. 2 further folded up upon itself.

As depicted in FIG. 3, tube 10 is next manipulated into a second folded position 26. Specifically, starting with aligned ends 14 and 16, tube 10 is again folded inside-out over itself, as shown by arrows 28 in FIG. 2, until ends 14 and 16 are positioned a distance part way toward fold 24. In second folded position 26, tube 10 extends between annular first fold 24 and an opposing annular second fold 28. Ends 14 and 16 are disposed between folds 24 and 28.

Figure 4:
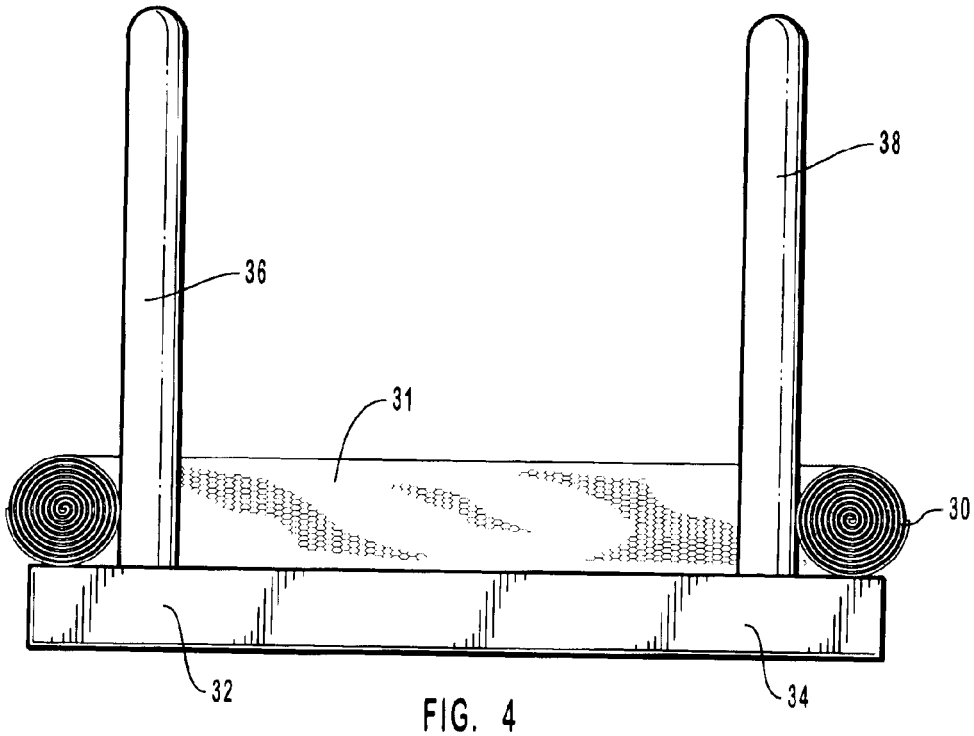
FIG. 4 is an elevated side view in partial cross section of a support structure having a band formed from the tube in FIG. 3 stretched thereon.
Figure 6:
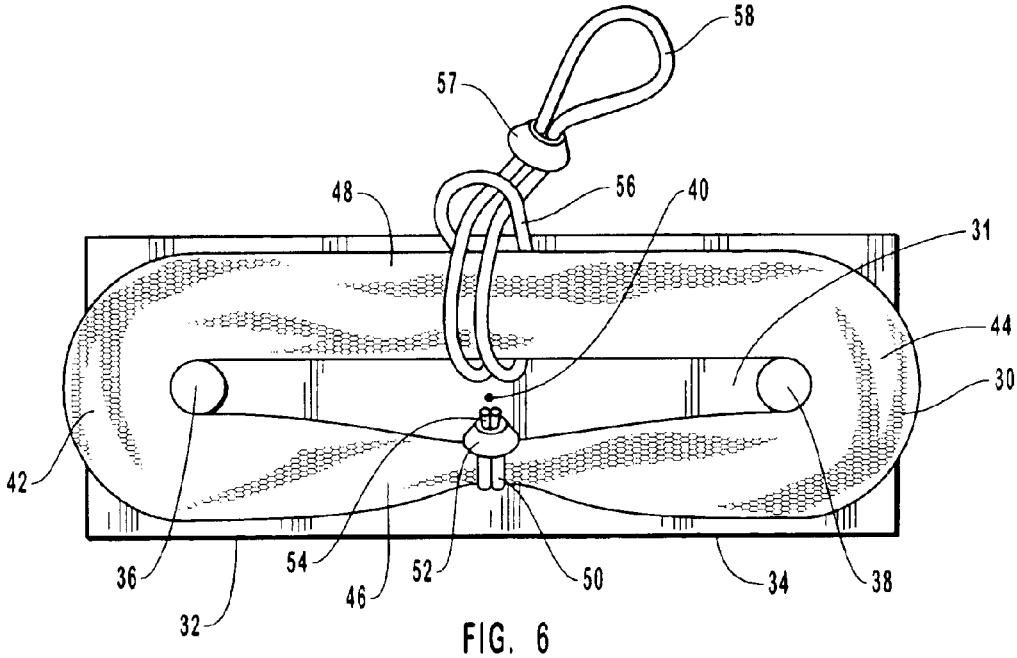
FIG. 6 is a top plan view of the assembly shown in FIG. 5 showing the opposing central portions of the bands being secured together.

Depicted in FIG. 4, tube 10 is next manipulated into a substantially doughnut shaped band 30. Specifically, starting with second fold 28, tube 10 is outwardly rolled onto itself repeatedly, as shown by arrows 32 in FIG. 3, so that ends 14 and 16 are enclosed with band 30 and only first fold 24 is exposed. As shown in FIG. 6, the resulting band 30 bounds a central opening 31. The above discussed process results in free ends 14 and 16 of tube 10 being enclosed within band 30, thereby minimizing fraying or unraveling of band 30. Furthermore, band 30 has a substantially constant uniformly smooth exposed exterior surface.

In alternative embodiments, it is appreciated that band 30 can be formed using a variety of alternative steps. For example, band 30 can be formed having one or both of ends 14 and 16 exposed. In one such embodiment, starting with either end 14 or 16, tube 10 is outwardly rolled onto itself to the opposing end without any folding. Alternatively, tube 10 can be rolled after one or three or more discrete folds. It is appreciated that countless variations on the folding technique are possible without departing from the spirit of the present invention. Furthermore, the one or more folds need not be outward but can also be inward within tube 10. In yet another embodiment, tube 10 need not be rolled at all but can simply be folded, using multiple folds, into a band or be otherwise gathered into a band.

Figure 5:
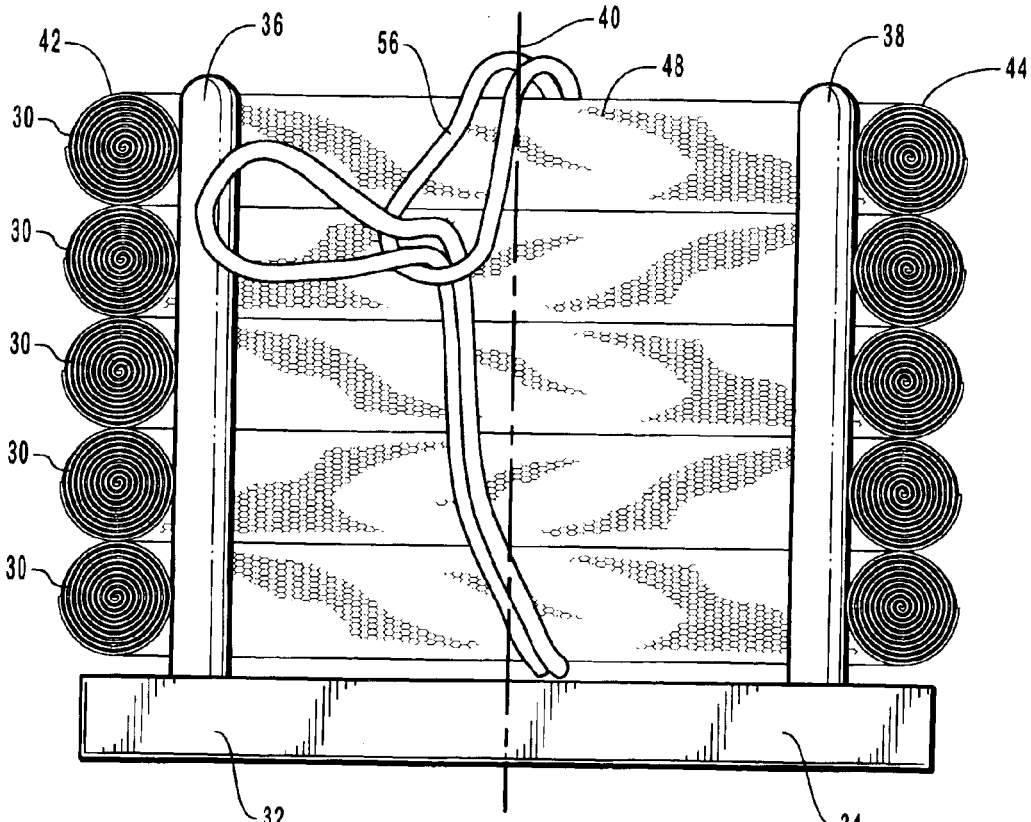
FIG. 5 is an elevated side view in partial cross section of the support structure of FIG. 4 with a plurality of bands stretched thereon.

As depicted in FIG. 4, once band 30 is formed, band 30 is stretched on a support structure 32. In one embodiment, support structure 32 comprises a base 34 having a pair of spaced apart posts 36 and 38 upwardly projecting therefrom. Band 30 is stretched over posts 36 and 38 so that band 30 encircles both posts 36 and 38 as shown in FIGS. 4–6. In alternative embodiments, support structure 32 can have a variety of alternative configurations. By way of example and not by limitation, support structure 32 can comprise 3 or more posts over which band 32 is stretched. In another embodiment, the support structure can include no posts. For example, band 30 can be stretched between opposing ends of a board so as to encircle the board. In yet another embodiment, support structure 32 can comprise a single large post having any desired circular or polygonal configuration over which band 30 is stretched. Finally, in one embodiment, band 30 need not be stretched at all but can simply be freely stacked without the use of a support structure.

Once band 30 is formed, the above process is repeated for separate lengths of tube 10 so as to produce a plurality of discrete bands 30. Bath sponge 60 is typically comprised of between 3 bands to 8 bands with 4 bands to 8 bands being more preferred, although any number of bands can be used. As depicted in FIGS. 5 and 6, each discrete band 30 is stretched over support structure 32 so that bands 30 are adjacently positioned with at least a portion of central opening 31 of each band 30 being aligned along a longitudinal axis 40.

It is appreciated that each band 30 can be made from the same or different material and can have the same or different color. For example, in one embodiment bands 30 can be formed of different colors with each color corresponding to a material having a different softness. The different softnesses can then be selectively used for cleaning different parts of the body. Furthermore, a single band 30 can be formed having a first tube centrally disposed within a separate second tube. The first and second tubes can also be formed of different colors and/or materials so as to affect the resulting properties of the final sponge.

As depicted in FIGS. 5 and 6, when disposed on support structure 32 each band 30 has opposing end portions 42 and 44 located adjacent to posts 36 and 38, respectively, and opposing central portions 46 and 48 extending between posts 36 and 38. In this stacked position, central portions 46 of bands 30 are secured together and central portions 48 of bands 30 are secured together. In one embodiment central portions 46 are secured together by securing a cord 50 simultaneously around all of central portions 46 by forming a cow hitch. The cow hitch is tightened so that each of central portions 46 are tightly gathered together at a single location. A fastening device 52 having a tubular frustoconical configuration in then passed over a free end 54 of cord 50 and biased against the cow hitch so as to securely hold the cow hitch by frictional engagement. Further disclosure with regard to fastening device 52 and alternative embodiments and configurations thereof are disclosed in U.S. Pat. Nos. 5,766,700 and 5,946,780 which are incorporated herein by specific reference. The '780 patent also provide disclose with regard to different types and configurations of materials that can be used for tube 10.

Fastening device 52 is position so as to face central opening 31. As a result, fastening device 52 is not openly exposed in the final formation of bath sponge 60. In one embodiment, free end 54 of cord 50 is trimmed back adjacent to fastening device 52 so that no loose ends are present.

In one embodiment, central portions 48 are secured together using substantially the same process that central portions 46 are secured together. That is, a separate cord 56 and fastening device 57 are used to tightly secure together each of central portions 48 at a discrete location using a cow hitch. Cord 56 has an elongated continuous loop configuration. In this regard, a free end 58 of cord 56 extends from fastening device 57 in a loop configuration so as to form a handle.

It is appreciated that the use of a cord and fastening device is only one of many different ways that can be used for securing together central portions 46 and central portions 48. By way of example and not by limitation, cord, string, wire, ribbon, or any other type of line can be independently wrapped or tied around the central portions without the use of any type of fastening device. Furthermore, as discussed above, the fastening devices can have a variety of different configurations. It is also appreciated that various crimping rings, self-locking plastic ties, and other conventional forms of attachment can be used. In addition, the handle formed by free end 58 of cord 56 can be added separately from the structure that is used to secure central portions 48.

Once central portions 46 and 48 are secured, bands 30 are removed from support structure 32. As depicted in FIG. 7, bands 30 automatically rebound from their stretched position into a substantially spherical configuration, thereby forming bath sponge 60. Each band 30 of bath sponge 60 is biased on at least one side by an adjacent band 30. Central opening 31 of each band 30 is cumulatively disposed within bath sponge 60 so as to form a central pocket 62. Central pocket 62 can be access by slots 64 formed between each of bands 30.

Because bands 30 are secured together twice, once at each central portion 46 and 48, bath sponge 60 is more durable and resistant to unraveling. Moreover, the formation of central pocket 62 facilitates rinsing and drying bath sponge 60. Furthermore, the formation of central pocket 62 allows for soap or other objects to be selectively placed within central pocket 62. For example, a solid soap product, children's toy, stuffed animal, and/or other object can be placed within central pocket 62.

To help prevent an object from slipping out of central pocket 62, the object can be secured to the cord or other line used in securing central portions 46 and 48 together. Furthermore, additional mesh netting or other material can be placed in the center to act as a chamber for holding the object. For example, a shell of flexible mesh material can be placed, tied, or bound within central pocket 62. Alternatively, a sufficient number of bands 30 can be used so that bands 30 are sufficiently tightly packed to securely hold the object within central pocket 62 but yet allow selective removal of the object.

The finished product is a bath sponge that has improved strength and durability. In addition, the sponge is simple and easy to produce, long lasting, and more resistant to unraveling. Also, the bath sponge has a unique look and feel that is an alternative to those disclosed in the prior art. The sponge is not only aesthetically pleasing but is also tactilely pleasing and gentle on the skin. This is because the sponge has a substantially smooth exterior surface.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for manufacturing a bath sponge, the method comprising:

manipulating each of a plurality of discrete lengths of flexible mesh-netting tube so that each mesh-netting tube is formed into a band, the act of manipulating comprising at least partially rolling each mesh-netting tube so that each tube has a substantially doughnut shaped configuration, each band bounding a central opening;

adjacently positioning each of the bands so that at least a portion of the central opening of each band is aligned along a longitudinal axis; and securing each of the aligned bands together at two spaced apart locations so as to produce a substantially spherical sponge.

2. A method according to claim 1, further comprising folding each mesh-netting tube over itself at least once prior to rolling.

3. A method according to claim 1, wherein the act of adjacently positioning each of the bands comprises stretching each band over a support structure.

4. A method according to claim 1, wherein the act of adjacently positioning each of the bands comprises stretching each band over a pair of spaced apart posts.

5. A method according to claim 1, wherein the act of securing comprises using separate cords to tie the bands together at the two spaced apart locations.

6. A method according to claim 5, further comprising positioning a fastening device on at least one of the cords so as to keep the cord in place.

7. A method according to claim 1, further comprising positioning an object within a central pocket formed within the spherical sponge.

8. A method for manufacturing a bath sponge, the method comprising:

at least partially rolling each of a plurality of discrete lengths of flexible mesh-netting tube so that each mesh-netting tube is formed into a discrete substantially doughnut shaped band, each band bounding a central opening;

stretching each band on a support structure so that the central opening of each band is at least partially aligned;

securing each of the bands together at a first location;

securing each of tho bands together at a second location substantially opposite the first location; and releasing the stretched bands from the support structure so as to produce a substantially spherical bath sponge.

9. A method according to claim 8, further comprising folding at least one of the mesh-netting tubes over itself at least once prior to rolling.

10. A method according to claim 8, wherein the act of stretching each band on a support structure comprises stretching each band over a pair of spaced apart posts.

11. A method according to claim 8, wherein the act of securing each of the bands together at a first location comprises tying a line around each of the bands at the first location.

12. A method according to claim 8, wherein the act of securing each of the bands together at a first location comprises:

passing a cord around each of the bands at the first location; and mounting a fastening device on the cord so as to hold the cord in position.

13. A method according to claim 8, further comprising positioning an object within a central pocket formed within the spherical sponge.

14. A method according to claim 13, wherein the object is soap, a toy, or a stuffed animal.

15. A bath sponge comprising a plurality of bands each having a substantially doughnut shaped configuration, each band bounding a central opening and being comprised of a flexible mesh-netting material, each band being secured together at a first location and a spaced apart second location so that the bands form a substantially spherical configuration with the central opening of each band forming a portion of a central pocket.

16. A bath sponge as recited in claim 15, wherein each band comprises an elongated mesh-netting tube that has been manipulated into a band.

17. A bath sponge as recited in claim 15, further comprising an object disposed within the central pocket.

18. A bath sponge as recited in claim 15, wherein the plurality of bands comprises four or more discrete bands.

* * * * *

UNITED STATES PATENT AND TRADEMARK OFFICE

CERTIFICATE OF CORRECTION

PATENT NO. : 6,871,375 B2
DATED : March 29, 2005
INVENTOR(S) : Suzanne Borcherds It is certified that error appears in the above-identified patent and that said Letters Patent is hereby corrected as shown below:

Title page,
Item [56], References Cited, U.S. PATENT DOCUMENTS, please add:

| | | | |
|---|---|---|---|
| -- 6,015,242 * | 1/2000 | Gillis | 401/201 |
| 6,161,246 * | 12/2000 | Trachtenberg | 15/229.13 |
| 6,368,003 * | 4/2002 | Sorrell | 401/185 -- |

Signed and Sealed this

Ninth Day of August, 2005

JON W. DUDAS
*Director of the United States Patent and Trademark Office*